US008042347B2

(12) United States Patent
Sawada et al.

(10) Patent No.: US 8,042,347 B2
(45) Date of Patent: Oct. 25, 2011

(54) COMPRESSOR INLET PRESSURE ESTIMATION APPARATUS FOR REFRIGERATION CYCLE SYSTEM

(75) Inventors: Yoshikatsu Sawada, Kariya (JP); Yasutane Hijikata, Nagoya (JP)

(73) Assignee: DENSO CORPORATION, Kariya (JP)

( * ) Notice: Subject to any disclaimer, the term of this patent is extended or adjusted under 35 U.S.C. 154(b) by 783 days.

(21) Appl. No.: 12/153,710

(22) Filed: May 22, 2008

(65) Prior Publication Data

US 2008/0295532 A1 Dec. 4, 2008

(30) Foreign Application Priority Data

May 28, 2007 (JP) ..... 2007-140320

(51) Int. Cl.
*G01K 13/00* (2006.01)

(52) U.S. Cl. ..... 62/129; 62/127; 62/157; 62/158; 62/178; 62/180; 62/228.1; 62/228.3; 62/228.4; 62/228.5; 62/231; 702/1; 702/33; 702/34; 702/41; 702/187; 702/189; 700/299; 700/300; 374/141; 374/143; 374/16; 374/174; 374/134

(58) Field of Classification Search ..... 62/127, 62/129, 157, 158, 178, 180, 228.1, 228.3–228.5, 62/231; 702/1, 33, 34, 41, 44, 127, 130, 702/182, 187, 189; 700/299, 300; 374/141, 374/143, 16, 147, 33, 134
See application file for complete search history.

(56) References Cited

U.S. PATENT DOCUMENTS

| | | | | |
|---|---|---|---|---|
| 4,909,043 | A * | 3/1990 | Masauji et al. | 62/158 |
| 5,189,611 | A * | 2/1993 | Petzold et al. | 701/58 |
| 5,291,390 | A | 3/1994 | Satou | |
| 5,902,346 | A * | 5/1999 | Cullen et al. | 701/102 |
| 6,237,681 | B1 | 5/2001 | Takano et al. | |
| 7,392,659 | B2 * | 7/2008 | Hong et al. | 62/115 |
| 2003/0213256 | A1 * | 11/2003 | Ueda et al. | 62/230 |
| 2005/0217292 | A1 | 10/2005 | Onishi et al. | |

FOREIGN PATENT DOCUMENTS

| | | |
|---|---|---|
| EP | 1 489 370 | 12/2004 |
| JP | A-61-91706 | 5/1986 |
| JP | A-4-329408 | 11/1992 |
| JP | A-10-153353 | 6/1998 |
| JP | A-2000-142094 | 5/2000 |
| JP | A-2005-282972 | 10/2005 |
| JP | A-2007-140321 | 6/2007 |

OTHER PUBLICATIONS

Office Action dated Mar. 3, 2009 in corresponding Japanese patent application No. 2007-140320 (and English translation).
U.S. Appl. No. 12/153,709, May 22, 2008, Sawada et al.

* cited by examiner

*Primary Examiner* — Frantz F. Jules
*Assistant Examiner* — Azim Rahim
(74) *Attorney, Agent, or Firm* — Posz Law Group, PLC

(57) ABSTRACT

A compressor inlet pressure estimation apparatus for a refrigeration cycle system is disclosed. An electronic control unit 14 uses Tefin_lag(N) as an actual corrected temperature Tefin_AD(N) during a period Tp1 included in the timing t1 to t2. During a period Tp2 included in the timing t1 to t2, Tefin_fwd(N) is used as the actual corrected temperature Tefin_AD(N). Thus, a highly accurate corrected temperature Tefin_AD(N) can be determined over the on period (t1 to t2) of a compressor 2. In addition, Tefin_fwd(N) is used as the actual corrected temperature Tefin_AD(N) during the off period (t2 to 3) of the compressor 2. As a result, a highly accurate corrected temperature Tefin_AD(N) can be determined over the whole period including the on and off periods of the compressor 2. In this way, a highly accurate estimated value Ps_es(N) of the refrigerant inlet pressure of the compressor 2 can be determined.

2 Claims, 7 Drawing Sheets

COMPRESSOR INLET PRESSURE ESTIMATION APPARATUS FOR REFRIGERATION CYCLE SYSTEM

CROSS REFERENCE TO RELATED APPLICATIONS

This application is based on Japanese Patent Application No. 2007-140320 filed on May 28, 2007, the disclosure of which is incorporated herein by reference. This application is also related to U.S. application Ser. No. 12/153,709, entitled "COMPRESSOR INLET PRESSURE ESTIMATION APPARATUS FOR REFRIGERATION CYCLE SYSTEM," filed simultaneously on May 22, 2008 with the present application.

BACKGROUND OF THE INVENTION

1. Field of the Invention

This invention relates to an apparatus for estimating the inlet pressure of the compressor of a refrigeration cycle system.

2. Description of the Related Art

In the prior art, an automotive refrigeration cycle system including a compressor driven by a vehicle engine for compressing a refrigerant, a cooler for cooling a high-temperature high-pressure refrigerant discharged from the compressor, a decompressor for reducing the pressure of the refrigerant cooled by the cooler and an evaporator for evaporating the refrigerant reduced in pressure by the decompressor has been proposed (for example, Japanese Unexamined Patent Publication No. 2000-142094).

This conventional automotive refrigeration cycle system further includes a blower for blowing air toward the evaporator, in which the refrigerant is evaporated by absorbing heat from air sent from the blower. As a result, air sent from the blower is cooled by the refrigerant in the evaporator.

SUMMARY OF THE INVENTION

Since the refrigerant is in a gas-liquid phase, and the refrigerant temperature and refrigerant pressure are specified in one-to-one relationship in the evaporator of the automotive refrigeration cycle system, the present inventor has studied the possibility of estimating the refrigerant pressure in the evaporator and hence the inlet pressure of the compressor based on the detection value of a thermistor for detecting the temperature of air blown out from the evaporator.

The study by the present inventor shows that the detection value of the thermistor is delayed (response lag) behind the actual refrigerant temperature after starting the compressor. This lag is attributable to the thermal capacity of the evaporator and the thermistor.

Even in the case where the refrigerant pressure in the evaporator is estimated based on the detection value of the thermistor, therefore the estimation value lags behind the actual refrigerant pressure. In other words, the refrigerant pressure in the evaporator and the inlet pressure of the compressor cannot be estimated accurately.

In view of the aforementioned points, the object of this invention is to provide a novel compressor inlet pressure estimation apparatus for a refrigeration cycle system which can accurately estimate the inlet pressure of the compressor.

In order to achieve the aforementioned object, according to this invention, there is provided a compressor inlet pressure estimation apparatus for a refrigeration cycle system, comprising:

a compressor (2) for sucking, compressing and discharging the refrigerant;

a temperature sensor (13) for detecting the surface temperature of an evaporator making up the refrigeration cycle system with the compressor;

a first refrigerant temperature estimation means (S100) for estimating the refrigerant temperature in the evaporator based on a function set in accordance with the detection temperature of the temperature sensor; and a pressure estimation means (S180) for estimating the refrigerant inlet pressure of the compressor based on the refrigerant temperature estimated by the first refrigerant temperature estimation means;

wherein the function is the first-order lead function for estimating the refrigerant temperature in the evaporator based on the change rate of the surface temperature of the evaporator.

With the configuration described above, the estimated temperature in the evaporator can be determined with high accuracy, and therefore a novel compressor inlet pressure estimation apparatus for the refrigeration cycle system which can accurately estimate the inlet pressure of the compressor can be provided.

The compressor inlet pressure estimation apparatus for the refrigeration cycle system according to this invention may further comprise a second refrigerant temperature estimation means (S160) for estimating the refrigerant temperature in the evaporator by a means different from the first refrigerant temperature estimation means, and a setting means (S170) for setting the apparatus in such a manner that the value estimated by the second refrigerant temperature estimation means is used as an estimated temperature during a predetermined time period (Tp1) after starting the compressor and the value estimated by the first refrigerant temperature estimation means is used as an estimated temperature after the lapse of the predetermined time period (Tp1).

According to this invention, the second refrigerant temperature estimation means (S160) estimates the refrigerant temperature in the evaporator using the surface temperature of the evaporator detected by the temperature sensor (13) and the first-order lag function connecting, with a downwardly convex curve in the X-Y coordinate system with Y axis representing the refrigerant temperature in the evaporator and X axis the time, the surface temperature of the evaporator (6) detected by the temperature sensor (13) at the time of starting the compressor and an estimated target temperature (Tefin_C) providing an estimated refrigerant temperature a predetermined time (Ts) after the start of the compressor.

During the predetermined time period (Tp1) after starting the compressor, the estimated temperature of the first-order lag function is higher in estimation accuracy than the estimated temperature determined using the first-order lead function.

In view of this, according to this invention, the refrigerant temperature estimated by the second refrigerant temperature estimation means is used as an actual estimated temperature during the predetermined time period (Tp1) after starting the compressor, while the refrigerant temperature estimated by the first refrigerant temperature estimation means is used as an actual estimated temperature after the predetermined time period (Tp1). In this way, the estimated temperature can be determined with higher accuracy. Thus, the inlet pressure of the compressor can be estimated even more accurately.

The compressor inlet pressure estimation apparatus for the refrigeration cycle system according to this invention may further comprise a sampling means (S90) for sampling the evaporator temperature by the temperature sensor (13) for each predetermined time period (Δt) set to not less than one second.

As a result, the sampling value of the detection temperature of the temperature sensor (13) changes smoothly with time suitably for estimation of the inlet pressure of the compressor.

The reference numerals inserted in the parentheses following the respective names of the means included in the appended claims and the foregoing description indicates the correspondence with the specific means described in the embodiments later.

This invention may be more fully understood from the description of preferred embodiments of the invention, as set forth below, together with the accompanying drawings.

DESCRIPTION OF THE PREFERRED EMBODIMENTS

Figure 1:
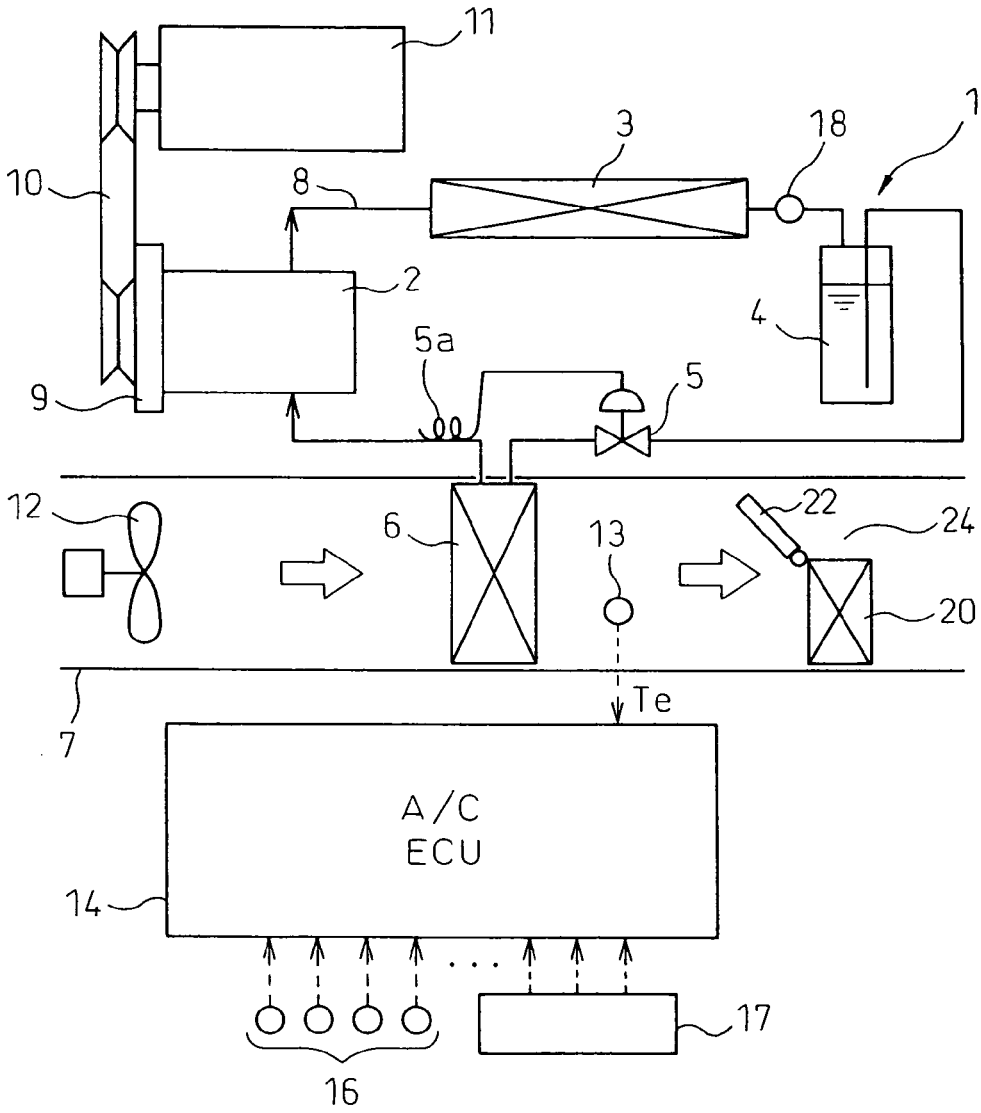
FIG. 1 is a diagram showing a general configuration for a refrigeration cycle system according to this invention.

An embodiment of the invention will be explained with reference to the drawings. FIG. 1 is a diagram showing the general configuration of a refrigeration cycle system of an automotive air conditioning system according to an embodiment of the invention. The refrigeration cycle system 1 includes a compressor 2 for sucking, compressing and discharging the refrigerant.

The compressor 2 is a variable displacement compressor driven by a vehicle engine 11 through an electromagnetic clutch 9, a belt 10, etc.

The gas refrigerant high in temperature and pressure discharged from the compressor 2 flows into a condenser (cooler) 3, which in turn cools the gas refrigerant with the external air blown in by a cooling fan (not shown). The refrigerant condensed by the condenser 3 flows into a liquid receiver (gas-liquid separator) 4, which stores the extraneous refrigerant (liquid-phase refrigerant) by separating the gas refrigerant and the liquid refrigerant from each other. The liquid refrigerant from the liquid receiver 4 is reduced to a low pressure by an expansion valve 5.

The low-pressure refrigerant from the expansion valve 5 flows into an evaporator 6. The evaporator 6 is arranged in an air-conditioning case 7 making up an air path of the automotive air conditioning system. The low-pressure refrigerant that has flowed into the evaporator 6 is evaporated by absorbing heat from air blown from an electrically-operated blower 12. The expansion valve 5 is a temperature-type expansion valve having a temperature sensing unit 5*a* for sensing the temperature of the outlet refrigerant of the evaporator 6 and adjusts the valve opening degree (refrigerant flow rate) in such a manner as to maintain a predetermined value of the degree of superheat of the outlet refrigerant of the evaporator 6.

The parts (1 to 6) making up the refrigeration cycle system described above are coupled to each other by a refrigerant pipe 8 and make up a closed circuit.

The blower 12 is arranged in the air-conditioning case 7, and air (internal air) in the passenger compartment or air (external air) outside the passenger compartment introduced from a well-known internal/external air switching box (not shown) is blown into the passenger compartment through the air-conditioning case 7 by the blower 12. A temperature sensor 13 including a thermistor for detecting the temperature of the blown air immediately after passing through the evaporator 6 is arranged at the part immediately following the air blowout from the evaporator 6 in the air-conditioning case 7.

According to this embodiment, the temperature sensor 13 is used for detecting the surface temperature of the evaporator 6.

A heater unit 20 is arranged on the downstream side of the evaporator 6. In the heater unit 20, the air cooled by the evaporator 6 is heated by the engine cooling water (warm water). A bypass 24 for passing the cool air blown from the evaporator 6 is arranged on the side of the heater unit 20, and an air mix door 22 is arranged on the upstream side of the heater unit 20.

The air mix door 22 regulates the temperature of the air blown into the compartment, by adjusting the ratio between the quantity of the air flowing into the heater unit 20 and the quantity of the air flowing into the bypass 24. The air mix door 22 is driven by a servo motor (not shown).

The electronic control unit 14 for the climate control system makes up "the compressor inlet pressure estimation apparatus for the refrigeration cycle system" described in the appended claims together with the high-pressure sensor 18, the flow rate sensor 35 (described later) and the temperature sensor 13.

The sensor group 16 specifically includes an internal air sensor, an external air sensor, a sunlight sensor and an engine water temperature sensor, while the operating switches on the air-conditioning operation panel 17 specifically include a temperature setting switch, an air capacity setting switch and an air-conditioning switch for issuing a start command to the compressor 2.

The electronic control unit 14 for the air-conditioning system is supplied with the detection signal of a high-pressure sensor 18. The high-pressure sensor 18 detects the refrigerant pressure on high-pressure side between the refrigerant outlet of the compressor 2 and the refrigerant inlet of the expansion valve 5 in the refrigeration cycle system 1. In the shown case, the high-pressure sensor 18 is arranged in the refrigerant pipe on the outlet side of the condenser 3.

Figure 2:
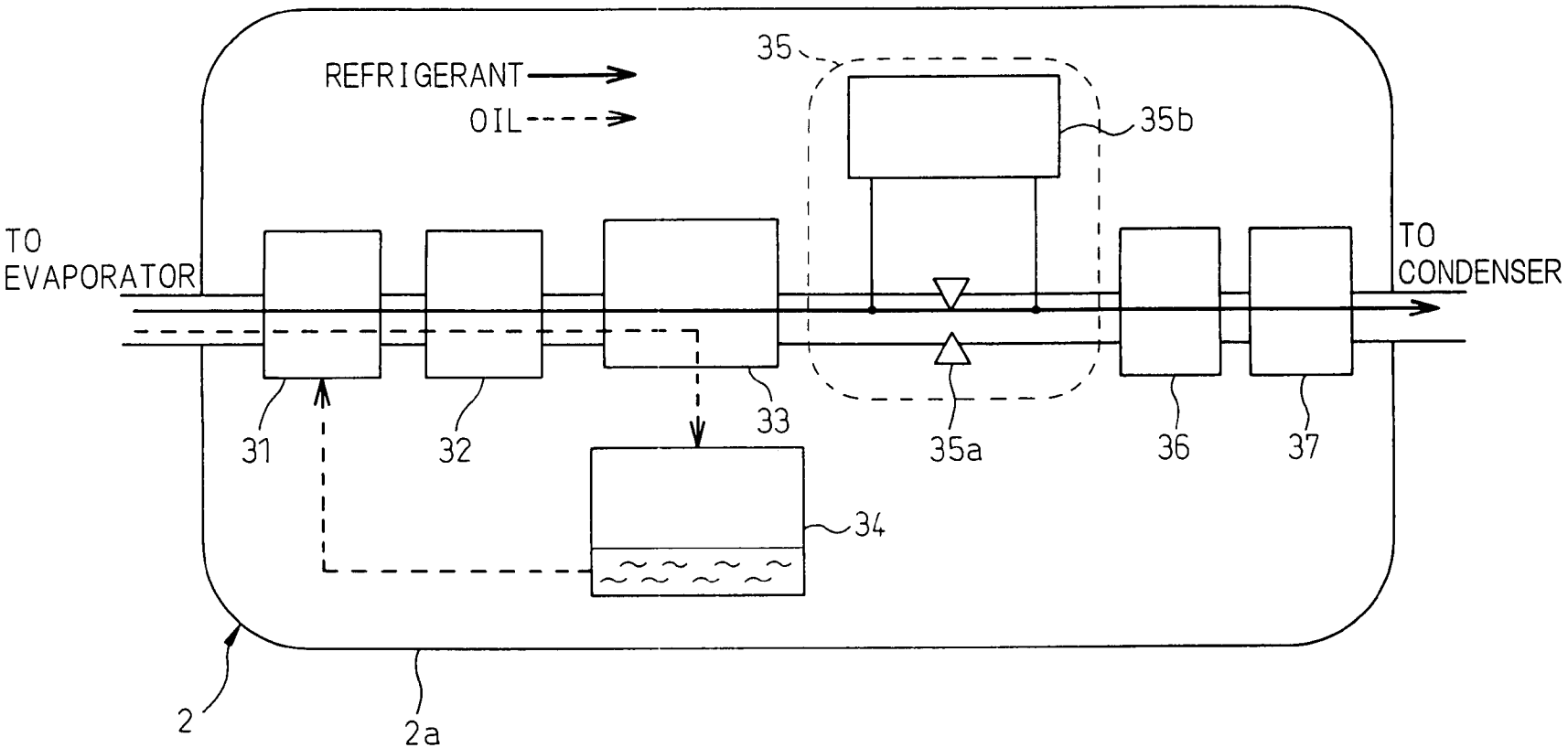
FIG. 2 is a diagram showing the internal configuration of a compressor 2 shown in FIG. 1.

Next, the internal configuration of the compressor 2 according to this embodiment will be explained with reference to FIG. 2.

The housing 2*a* of the compressor 2 has an inlet 31 for taking in the refrigerant and an outlet 37 for discharging the refrigerant. A compression mechanism 32 is arranged in the housing 2*a*. The compression mechanism 32 compresses the refrigerant taken in through the inlet 31. An oil separator 33 separates the lubricating oil from the refrigerant compressed by the compression mechanism 32.

A flow rate sensor 35 (refrigerant flow rate sensor) is arranged on the downstream side of the oil separator 33. The flow rate sensor 35 is for detecting the flow rate of the refrigerant from which the lubricating oil is removed by the oil separator 33. The flow rate sensor 35 includes a throttle 35*a* for reducing the flow rate of the refrigerant supplied from the oil separator 33, and a pressure difference detection mechanism 35*b* for detecting the refrigerant pressure difference between the upstream and downstream sides of the throttle 35*a* in the refrigerant flow. The refrigerant that has passed through the flow rate sensor 35 is discharged from the outlet 37 through a check valve 36.

The electronic control unit 14 calculates the refrigerant flow rate based on the refrigerant pressure difference and the density of the discharged refrigerant (according to Bernoulli's law).

The high pressure and the refrigerant temperature are basically required to determine the density of the discharged refrigerant. However, in a certain high-pressure range where the pressure and the discharged refrigerant density can be specified in one-to-one relationship, and therefore the discharged refrigerant density can be specified only with the high pressure. Specifically, the refrigerant pressure difference, the high pressure and the discharged refrigerant flow rate are specified in one-to-one-to-one relationship.

According to this embodiment, the electronic control unit 14 includes a memory for storing a map indicating the relationship between the output (refrigerant pressure difference) of the flow rate sensor 35, the output (high pressure output) of the high pressure sensor 18 and the discharged refrigerant flow rate. The electronic control unit 14 determines the flow rate of the discharged refrigerant based on the map stored in the memory, the output of the flow rate sensor 35 and the output of the high pressure sensor 18.

Figure 3:
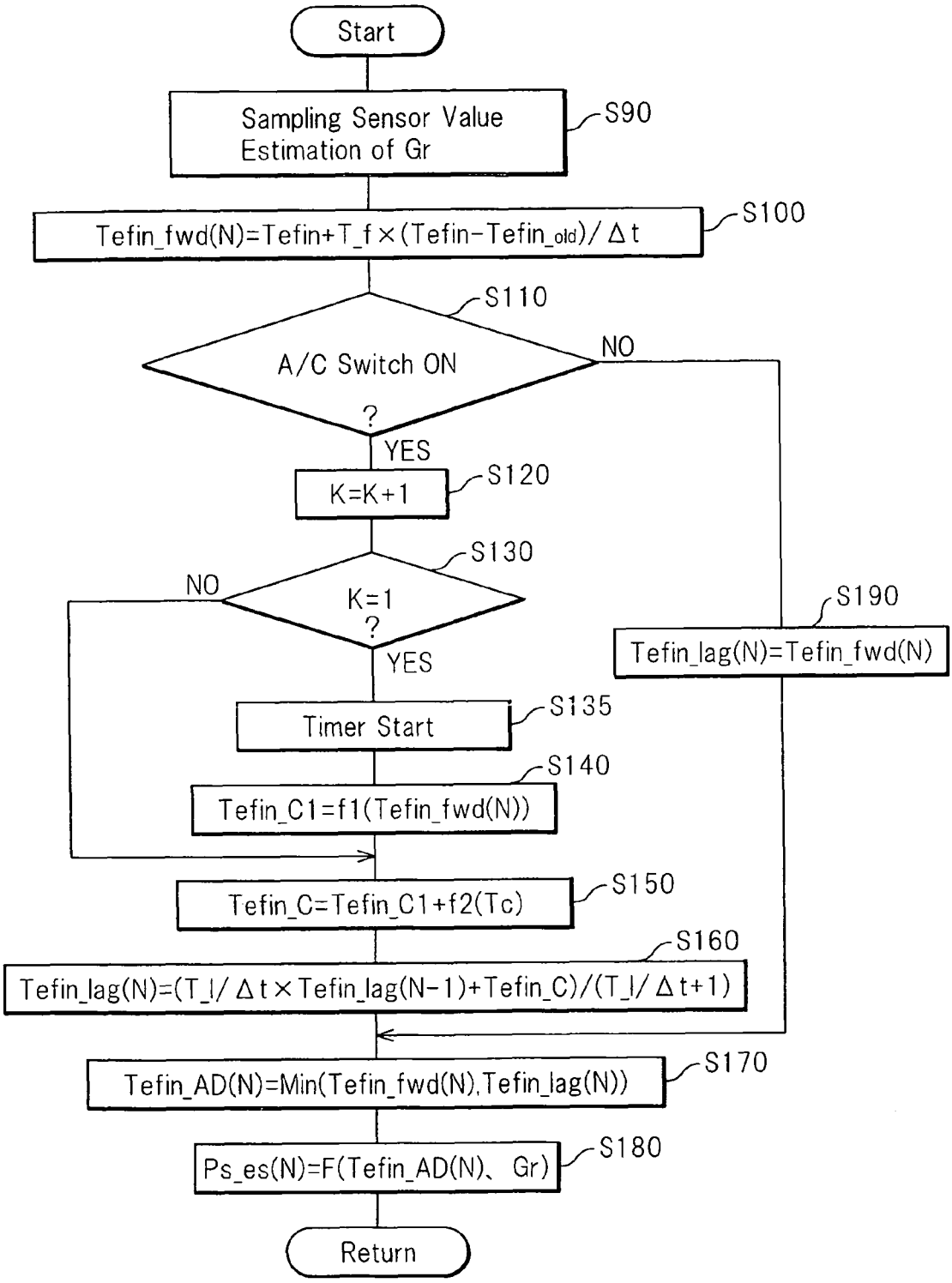
FIG. 3 is a flowchart showing the process executed by an electronic control unit shown in FIG. 1 to estimate the refrigerant inlet pressure.

Next, the process executed by the electronic control unit 14 for estimating the refrigerant inlet pressure of the compressor 2 will be explained with reference to FIG. 3. FIG. 3 is a flowchart showing the process of estimating the refrigerant inlet pressure, and the ELECTRONIC CONTROL UNIT 14 executes the process of estimating the refrigerant inlet pressure in accordance with the flowchart of FIG. 3. Once an ignition switch IG is turned on, the execution of the process of estimating the refrigerant inlet pressure is started for each predetermined time period Δt.

Step S90 samples the temperature detected by the temperature sensor 13, the pressure detected by the high-pressure sensor 20 and the refrigerant pressure difference detected by the flow rate sensor 35. The flow rate of the discharged refrigerant is determined based on the sampling value of the pressure detected by the high-pressure sensor 20, the sampling value of the refrigerant pressure difference detected by the flow rate sensor 35 and the map described above. In the description that follows, the sampling value of the detection value of the temperature sensor 13 is designated as Tefin, and the discharged refrigerant flow rate as Gr.

In step S100, the corrected temperature Tefin_fwd(N) is calculated by substituting the sampling value Tefin into Equation (1). N is the number of times the corrected temperature is calculated, and T_f a time constant.

$$\text{Tefin_fwd}(N)=\text{Tefin}+T_f\times(\text{Tefin}-\text{Tefin_old})/\Delta t \quad (1)$$

Equation (1) indicates the first-order lead function for determining the corrected temperature after correction of the lag of Tefin behind the actual refrigerant temperature in the evaporator 6. This first-order lead function is for estimating the refrigerant temperature in the evaporator based on the rate at which the surface temperature of the evaporator 6 changes. Tefin_old is the sampling value of the detection value of the temperature sensor 3 used for the previous calculation of the corrected temperature.

The same value as Tefin is used as Tefin_old in the first calculation of the corrected temperature after starting the execution of the computer program.

The next step S110 judges whether the air-conditioning switch (A/C switch) is turned on or not by the occupant, i.e. whether the command to start the compressor 2 is issued or not.

In the case where the A/C switch is on, the command to start the compressor 2 is regard to have been issued, and the judgment is given as YES. In this case, in step S120, the count K on the counter is incremented by 1 (K=K+1) and set to 1.

The next step S130 judges whether the count K on the counter is 1 or not. In the case where the count K is 1, the judgment is given as YES, and the timer is started to count (step S135).

The timer is for counting the time elapsed after the A/C switch is turned on (i.e. after the compressor 2 is started), and the time counted by the timer is hereinafter referred to as Tc.

Figure 4:
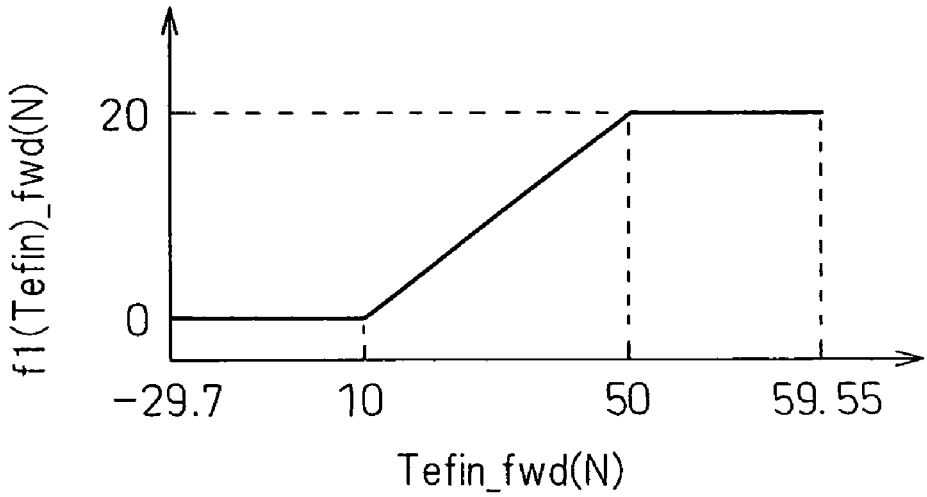
FIG. 4 is a characteristic diagram used for the process of estimating the refrigerant inlet pressure in FIG. 3.

The control proceeds to the next step S140 in which Tefin_C1 is determined based on Equation (2).

$$\text{Tefin_}C1=f1(\text{Tefin_fwd}(N)) \quad (2)$$

where f1(Tefin_fwd(N)) and Tefin_fwd(N) are related to each other as shown in the graph of FIG. 4, and Tefin_C1 is determined based on this graph and Tefin_fwd(N). As described later, Tefin_C1 is used for determining the corrected temperature of Tefin based on a first-order lag function.

In the graph of FIG. 4, f1(Tefin_fwd(N)) remains constant at the minimum value (0° C.) as long as Tefin_fwd(N) is in the low temperature range (−29.7° C.≦Tefin_fwd(N)<10° C.). As long as Tefin_fwd(N) is in the high temperature range (50° C.≦Tefin_fwd(N)<59.55° C.), on the other hand, f1(Tefin_fwd(N)) remains constant at the maximum value (20° C.). In the case where Tefin_fwd(N) is in the intermediate temperature range (10° C.≦Tefin_fwd(N)<50° C.), f1(Tefin_fwd(N)) increases with Tefin_fwd(N).

Figure 5:
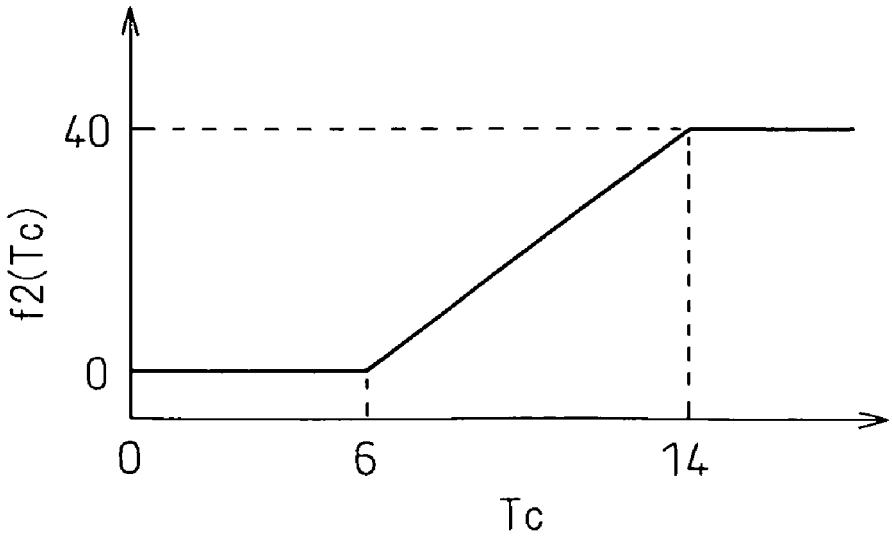
FIG. 5 is a characteristic diagram used for the process of estimating the refrigerant inlet pressure in FIG. 3.

The control proceeds to the next step S150, in which Tefin_C is determined based on Equation (3) below.

$$\text{Tefin_}C=\text{Tefin_}C1+f2(Tc) \quad (3)$$

where f2(Tc) and Tc are related to each other as shown in the graph of FIG. 5, and f2(Tc) is determined based on this graph and Tc. Further, f2(Tc) and Tefin_C1 are added to each other to determine Tefin_C.

As long as Tc is between 0 and 6 seconds not inclusive, f2(Tc)=0° C., while in the case where Tc is not longer than 6 seconds but shorter than 14 seconds, on the other hand, f2(Tc) gradually increases with the lapse of Tc. In the case where Tc is not shorter than 14 seconds, f2(Tc)=40° C.

The control proceeds to the next step S160, in which Tefin_C and the sampling value Tefin are substituted into Equation (4) below to calculate the corrected temperature Tefin_lag(N).

$$\text{Tefin_lag}(N)=(T_1/\Delta t\times\text{Tefin_lag}(N-1)+\text{Tefin_}C)/(T_1/\Delta t+1) \quad (4)$$

Equation (4) indicates the first-order lag function for determining the corrected temperature after correction of the lag of the sampling value Tefin behind the actual refrigerant temperature in the evaporator 6. Incidentally, the first-order lag function is described later.

Tefin_C is a parameter used for the first-order lag function expressed by Equation (4), and indicates an estimated target temperature constituting a refrigerant temperature estimated beforehand. Tefin_lag(N−1) is a corrected temperature calculated previously using the first-order lag function of Equation (4), and T_1 a time constant.

The control proceeds to step S170, in which the corrected temperature Tefin_fwd(N) and the corrected temperature Tefin_lag(N) are compared with each other, and the lower one of them is selected as a corrected temperature and used as the actual corrected temperature Tefin_AD(N).

The control proceeds to the next step S180, in which the estimated value Ps_es(N) of the refrigerant inlet pressure of the compressor 2 is determined based on Tefin_AD(N).

Specifically, the estimated refrigerant pressure Ps_Eba(N) in the evaporator 6 is determined by substituting Tefin_AD (N) into Equation (5) below.

$$Ps_Eba(N)=0.013\times\text{Tefin_}AD(N)-0.16 \quad (5)$$

Next, the estimated value Ps_es(N) of the refrigerant inlet pressure of the compressor 2 is determined by substituting Ps_Eba(N) into Equation (6) below.

$$Ps_es(N)=Ps_Eba(N)-(1.46/10\hat{}6)Gr \quad (6)$$

After that, the corrected temperature Tefin_fwd(N) is calculated in step S100 through the process of step S90.

Upon judgment, in the next step S110, that the A/C switch has been turned on by the occupant, i.e. the answer is YES, then the count K on the counter is incremented by 1 (K=K+1) and set to 2.

In this case, the next step S130 judges that the count K is not 1 and the answer is NO. Then, the control proceeds to step S150 to determine Tefin_C using the value determined in step S140 as Tefin_C1.

In the case where the A/C switch is kept on subsequently, the process of steps S150, S160, S170, S180, S90, S100, S110, S120 and S130 is repeated.

After that, the corrected temperature Tefin_fwd(N) is calculated in step S100 through step S90, and then the control proceeds to the next step S110. At the same time, in the case where the A/C switch is turned off by the occupant, the answer NO is given by judging that the command is issued to stop the starting of the compressor 2.

In this case, Tefin_fwd(N) determined in the preceding step S100 is set as Tefin_lag(N) in step S190 (Tefin_lag(N)=Tefin_ fwd(N)).

In the next step S170, the smaller one of Tefin_lag(N) and Tefin_fwd(N) is set as the actual corrected temperature Tefin_AD(N). In view of the fact that Tefin_lag(N) is set as equal to Tefin_fwd(N) in step S190 as described above, the relation holds that Tefin_AD(N)=Tefin_fwd(N)=Tefin_lag(N).

Next, the control proceeds to the next step S180 to determine the estimated value Ps_es(N) of the refrigerant inlet pressure of the compressor 2 based on Tefin_AD(N).

FIGS. 6 to 10 show the timing charts of the A/C switch, Tefin_fwd(N), Tefin_C, Tefin_lag(N) and Tefin_AD(N) respectively.

Figure 6:
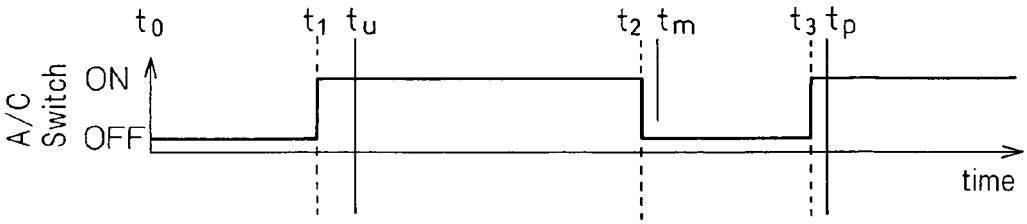
FIG. 6 is a timing chart showing the on/off timing of an air-conditioning switch in FIG. 1.

As shown in FIG. 6, the A/C switch is turned off at timing t0 to t1 and timing t2 to t3, and turned on at timing t1 to t2 and timing t3 and thereafter.

Figure 7:
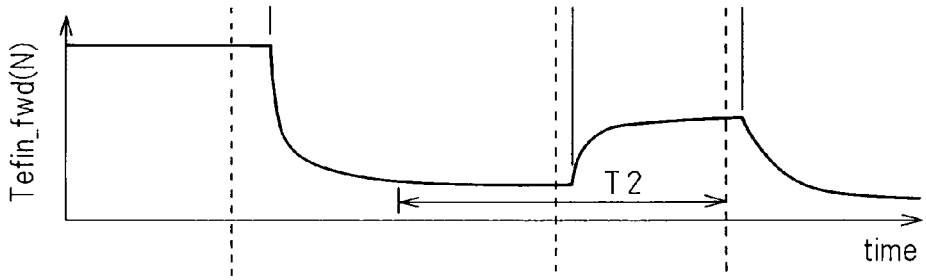
FIG. 7 is a timing chart of Tefin_fwd(N) determined by the refrigerant inlet pressure estimation process in FIG. 3.
Figure 8:
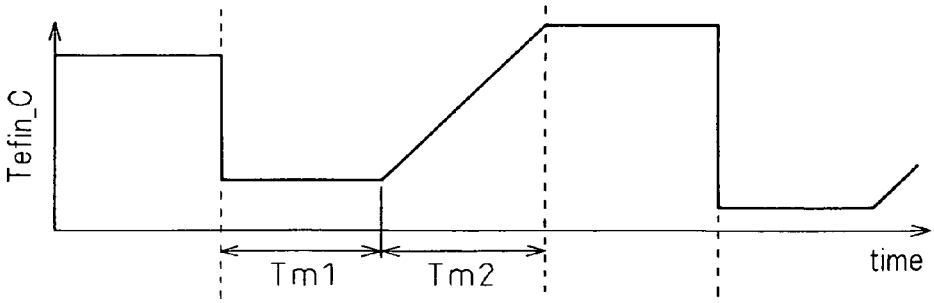
FIG. 8 is a timing chart of Tefin_C used for the refrigerant inlet pressure estimation process shown in FIG. 3.

FIG. 7 shows that Tefin_fwd(N) gradually increases at timing tm to t3 to tp. As shown in FIG. 8, Tefin_C assumes a constant value at timing t0 to t1, and after timing t1, sharply drops and remains at a constant value during the period Tm1 included in the timing t1 to t2. During the period Tm2 after the period Tm1, Tefin_C gradually increases with time, and subsequently at timing t2 to t3, remains at a constant value. After timing t3, Tefin_C sharply drops and remains at a constant value.

Figure 9:
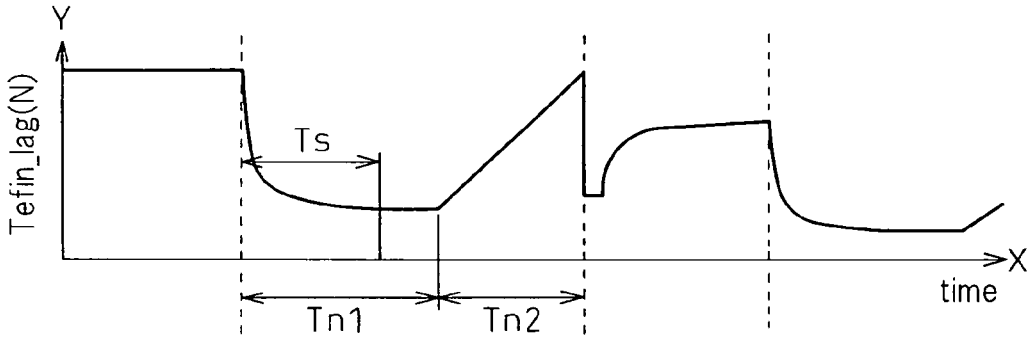
FIG. 9 is a timing chart of Tefin_lag(N) used for the refrigerant inlet pressure estimation process shown in FIG. 3.
Figure 10:
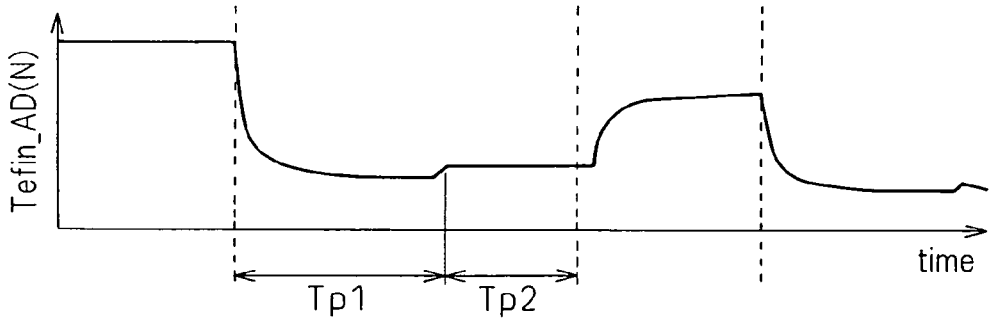
FIG. 10 is a timing chart of the sampling value Tefin used for the refrigerant inlet pressure estimation process shown in FIG. 3.

As shown in FIG. 9, Tefin_lag(N) indicates the first-order lag function, and follows Tefin_C at timing t0 to t1 to t2 and timing t3 and thereafter.

Specifically, at timing t1, Tefin_lag(N) assumes the same value as Tefin at the time of starting the compressor 2 (i.e. the detection value of the temperature sensor 13). Upon lapse of a predetermined time Ts after starting the compressor 2, Tefin_lag(N) assumes the same value as the estimated target temperature Tefin_C at the predetermined time Ts after starting the compressor 2.

Tefin_lag(N) is the function for connecting, with a downwardly convex curve in the X-Y coordinate system with Y axis representing the refrigerant temperature in the evaporator 6 and X axis the time, Tefin at the time of starting the compressor 2 and the estimated target temperature Tefin_C the predetermined time Ts after starting the compressor 2.

Tefin_lag(N), which gradually decreases with time and approaches a constant value during the period Tn1 included in the timing t1 to t2, gradually increases with time during the period Tn2 after the period Tn1.

From Tefin_lag(N) and Tefin_fwd(N) described above, Tefin_AD(N) shown in FIG. 10 is determined.

Specifically, during the period Tp1 included in the timing t1 to t2 (the on period of the compressor 2), Tefin_lag(N) is lower than Tefin_fwd(N), and therefore the relation holds that Tefin_AD(N)=Tefin_lag(N). During the period Tp2 included in the timing t1 to t2, on the other hand, Tefin_fwd(N) is lower than Tefin_lag(N), and therefore the relation holds that Tefin_AD(N)=Tefin_fwd(N).

At timing t2 to t3 (the off period of the compressor 2), Tefin_lag(N) assumes the same value as Tefin_fwd(N) through the process of step S190. Therefore, the relationship holds that Tefin_AD(N)=Tefin_lag(N)=Tefin_fwd(N).

According to the embodiment described above, Tefin_lag (N) is used as the actual corrected temperature Tefin_AD(N) during the period Tp1 included in the timing t1 to t2. During the period Tp2 included in the timing t1 to t2, on the other hand, Tefin_fwd(N) is used as the actual corrected temperature Tefin_AD(N).

According to this embodiment, Tefin_fwd(N) is calculated using the sampling value Tefin of the detected value of the temperature sensor 13 as described above.

For some time after starting the compressor 2, Tefin is delayed (response lag) behind the actual refrigerant temperature due to the thermal capacity of each of the evaporator 6 and the temperature sensor 13. In other words, Tefin begins to decrease belatedly after the actual refrigerant temperature begins to decrease. Therefore, for some time after starting the compressor 2, the corrected temperature of Tefin_lag(N) is higher in accuracy than that of Tefin_fwd(N).

According to this embodiment, Tefin_lag(N) is used as the actual corrected temperature Tefin_AD(N) during the period Tp1, while Tefin_fwd(N) is used as the actual corrected temperature Tefin_AD(N) during the period Tp2. Therefore, over the whole on period (t1 to t2) of the compressor 2, a highly accurate corrected temperature Tefin_AD(N) can be determined.

In addition, Tefin_fwd(N) is used as the actual corrected temperature Tefin_AD(N) during the off period (t2 to t3) of the compressor 2. As a result, a highly accurate corrected temperature Tefin_AD(N) can be acquired over the whole period including the on and off periods of the compressor 2. Thus, a highly accurate value Ps_es(N) can be determined as an estimated value of the refrigerant inlet pressure of the compressor 2.

According to this embodiment, the computer program is executed for each predetermined time period Δt to determine Tefin_AD(N). As a result, the temperature of the evaporator 6 is sampled for each predetermined time period Δt from the temperature sensor 13.

Figure 11:
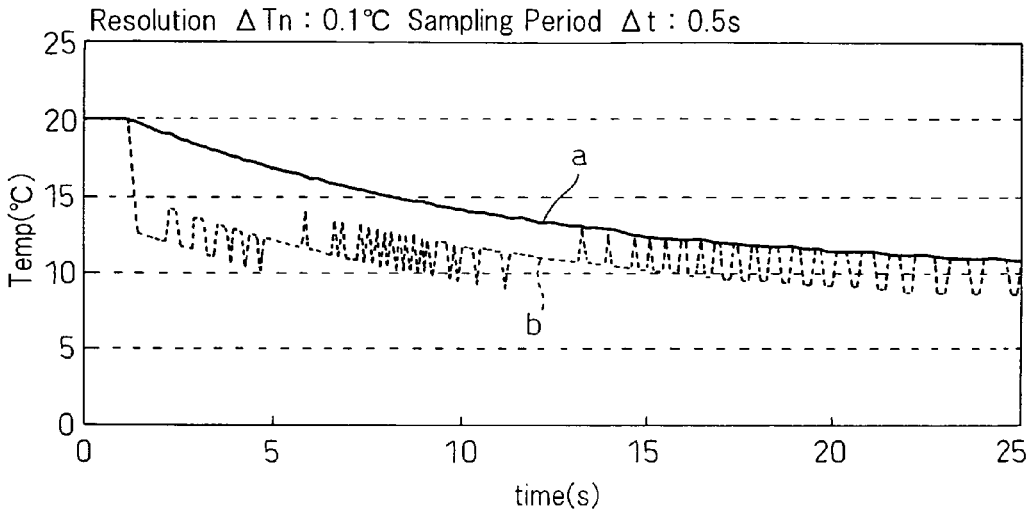
FIG. 11 is a timing chart showing the actual refrigerant temperature in the evaporator and the sampling value of the refrigerant temperature according to the same embodiment.
Figure 12:
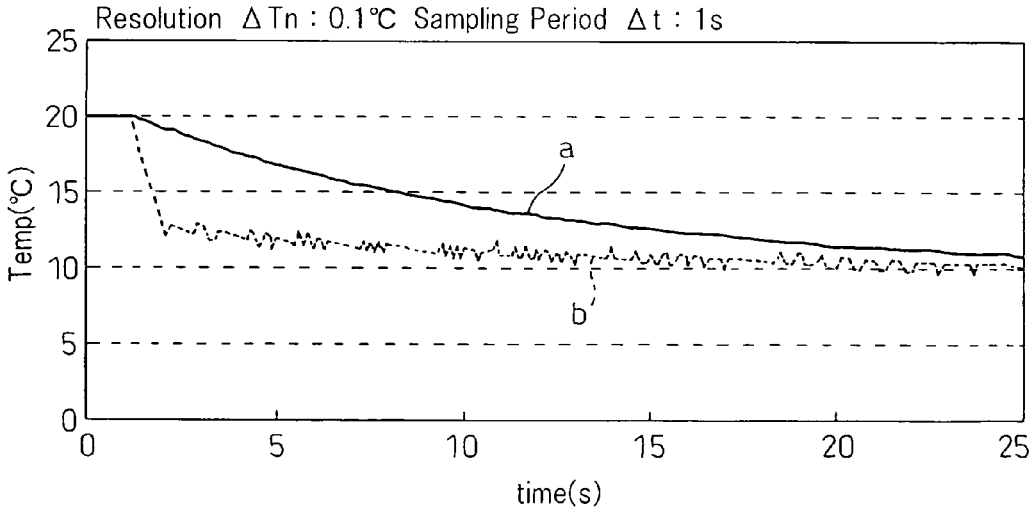
FIG. 12 is a timing chart showing the actual refrigerant temperature in the evaporator and the sampling value of the refrigerant temperature according to this embodiment.

In FIGS. 11 and 12 with the ordinate representing the temperature and the abscissa the time, the graph a (solid line) indicates the actual refrigerant temperature in the evaporator 6 and the graph b the sampling value Tefin.

FIG. 11 shows a case in which the resolution Δtn=0.1° C. and the predetermined time period Δt=0.5 s, and FIG. 12 a case in which the resolution Δtn=0.1° C. and the predetermined time period Δt=1.0 s.

In the case where the predetermined time period Δt is too short, as shown in FIG. 11, the sampling value Tefin undergoes great ups and downs with respect to the actual refrigerant temperature. In the case where the predetermined time period (sampling period) Δt has a proper length, as shown in FIG. 12, the ups and downs of the sampling value Tefin with respect to the actual refrigerant temperature are reduced and smoothed.

The study by the present inventor shows that in the case where the predetermined time period Δt is not shorter than 1.0 s, the proper change (inclination) of the sampling value Tefin is achieved. Especially, a smooth and suitable change (inclination) of the sampling value Tefin is obtained in the case where the relation Δtn/Δt≧10 holds between the sampling resolution Δtn and the predetermined time period (sampling period) Δt for sampling the detected temperature of the temperature sensor 13.

As a result, the proper change (inclination) of Tefin_AD(N) is obtained with time. Thus, the estimated value Ps_es(N) of the refrigerant inlet pressure of the compressor 2 increases in accuracy.

Other Embodiments

The embodiment described above represents a case in which a temperature sensor for detecting the blown air temperature immediately after passing through the evaporator 6 is used as "the temperature sensor 13 for detecting the surface temperature of the evaporator". However, this invention is not limited to this configuration, and a temperature sensor for detecting the outer surface temperature of the evaporator 6 may alternatively be used.

The embodiment described above represents a case in which the period Δt for calculating the corrected temperature using the first-order lead function is identical with the period Δt for calculating the corrected temperature using the first-order lag function. Nevertheless, the invention is not limited to this case, and the period Δt for calculating the corrected temperature using the first-order lead function may be different from the period Δt for calculating the corrected temperature using the first-order lag function.

The embodiment described above represents a case in which the electronic control unit 14 for the climate control system estimates the refrigerant inlet pressure of the compressor 2. Nevertheless, the invention is not limited to this case, and the refrigerant inlet pressure of the compressor 2 may be estimated by an electronic control unit for controlling the engine, or the process of estimating the refrigerant inlet pressure of the compressor 2 may be divided between the electronic control unit 14 for the climate control system and the electronic control unit for controlling the engine.

The embodiment described above represents a case in which the refrigeration cycle system according to the invention is used for the automotive climate control system. Nevertheless, the invention is not limited to this case, and the refrigeration cycle system according to the invention may be used with equal effect for the air-conditioning system of fixed type, the water heater of heat pump type or various other devices.

The embodiment described above represents a case in which the second refrigerant temperature estimation means estimates the refrigerant temperature in the evaporator 6 using the first-order lag function. Nevertheless, the invention is not limited to this case, and the second refrigerant temperature estimation means may estimate the refrigerant temperature in the evaporator 6 using other means than the first-order lag function.

For example, a map data indicating the relationship between the time elapsed after starting the compressor 2 and the refrigerant temperature (estimated refrigerant temperature) in the evaporator 6 is stored beforehand, and the refrigerant temperature in the evaporator 6 may be estimated using the map data and the elapsed time.

The correspondence between the scope of the appended claims and the embodiments described above will be explained. Specifically, the first refrigerant temperature estimation means corresponds to the control process of step S100, the pressure estimation means to the control process of step S180, the second refrigerant temperature estimation means to the control process of step S160, the setting means to the control process of step S170, and the sampling means to the control process of step S90.

While the invention has been described by reference to specific embodiments chosen for purposes of illustration, it should be apparent that numerous modifications could be made thereto by those skilled in the art without departing from the basic concept and scope of the invention.

The invention claimed is:

1. A compressor inlet pressure estimation apparatus for a refrigeration cycle system, the refrigeration cycle system comprising:

a compressor for sucking, compressing and discharging a refrigerant;

a cooler for cooling the refrigerant discharged from the compressor;

a decompressor for reducing the pressure of the refrigerant cooled by the cooler;

an evaporator for evaporating the refrigerant, which is reduced in pressure by the decompressor, by absorbing heat from air, the compressor inlet pressure estimation apparatus comprising:

a temperature sensor for detecting the surface temperature of the evaporator;

a first refrigerant temperature estimation means for estimating the refrigerant temperature in the evaporator based on a function set in accordance with the temperature detected by the temperature sensor; and a pressure estimation means for estimating the refrigerant inlet pressure of the compressor based on the refrigerant temperature estimated by the first refrigerant temperature estimation means;

wherein the function is a first-order lead function for estimating the refrigerant temperature in the evaporator based on a change rate of the surface temperature of the evaporator, the compressor inlet pressure estimation apparatus further comprising:

a second refrigerant temperature estimation means for estimating the refrigerant temperature in the evaporator by a means different from the first refrigerant temperature estimation means; and a setting means for setting the apparatus in such a manner that a value estimated by the second refrigerant temperature estimation means is used as an estimated temperature during a predetermined time period after starting the compressor and a value estimated by the first refrigerant temperature estimation means is used as an estimated temperature after the lapse of the predetermined time period, wherein the second refrigerant temperature estimation means estimates the refrigerant temperature in the evaporator after a certain time following the start of the compressor, using a first-order lag function for indicating a relationship between the time and the estimated refrigerant temperature in the evaporator, and wherein the first-order lag function connects, with a downwardly convex curve in the X-Y coordinate system with Y axis representing the estimated refrigerant temperature in the evaporator and X axis the time, the surface temperature of the evaporator detected by the temperature sensor at the time of starting the compressor and an estimated target temperature providing the estimated refrigerant temperature after a predetermined time following the start of the compressor.

2. The compressor inlet pressure estimation apparatus for a refrigeration cycle system according to claim 1, further comprising:

a sampling means for sampling the temperature detected by the temperature sensor for each predetermined time period, wherein the predetermined time period is set to not shorter than one second.

* * * * *